US008595896B2

(12) United States Patent
Shinler et al.

(10) Patent No.: US 8,595,896 B2
(45) Date of Patent: Dec. 3, 2013

(54) SQUEEGEE ASSEMBLY

(75) Inventors: Kevin L. Shinler, North Branch, MN (US); Coert Verhoeve, Veghel (NL)

(73) Assignee: Tennant Company, Minneapolis, MN (US)

( * ) Notice: Subject to any disclaimer, the term of this patent is extended or adjusted under 35 U.S.C. 154(b) by 415 days.

(21) Appl. No.: 12/942,172

(22) Filed: Nov. 9, 2010

(65) Prior Publication Data

US 2011/0107552 A1 May 12, 2011

Related U.S. Application Data

(60) Provisional application No. 61/259,421, filed on Nov. 9, 2009.

(51) Int. Cl.
*A47L 9/06* (2006.01)

(52) U.S. Cl.
USPC ..... 15/401; 15/245

(58) Field of Classification Search
USPC ..... 15/49.1, 98, 245, 401, 402
IPC ..... A47L 9/06
See application file for complete search history.

(56) References Cited

U.S. PATENT DOCUMENTS

| | | | | |
|---|---|---|---|---|
| 4,765,015 | A * | 8/1988 | Torta | 15/245 |
| 5,377,382 | A * | 1/1995 | Bores et al. | 15/340.1 |
| 5,579,555 | A | 12/1996 | Pearse | |
| 6,602,018 | B2 | 8/2003 | Feeny et al. | |
| 6,895,633 | B2 | 5/2005 | Tucker | |
| 7,254,867 | B2 | 8/2007 | Legatt et al. | |
| 7,287,299 | B2 | 10/2007 | Joynt | |
| 7,716,785 | B2 * | 5/2010 | Coccapani et al. | 15/402 |
| 2003/0051301 | A1 | 3/2003 | Morgan et al. | |

OTHER PUBLICATIONS

International Search Report and Written Opinion for PCT/US2010/055907, mailed Jan. 10, 2011.

* cited by examiner

*Primary Examiner* — David Redding
(74) *Attorney, Agent, or Firm* — Briggs and Morgan, P.A.; John F. Klos

(57) ABSTRACT

A squeegee assembly for a floor surface maintenance machine having a tabbed frame, an apertured front squeegee blade adapted to receive at least portions of the tabs of said frame, a tabbed vacuum core having a surface adapted to receive portions of the tabs of the frame, a rear squeegee blade having apertures adapted to receive at least portions of the tabs of the vacuum core; and a clamp band for securing the frame, front and rear squeegee blades and vacuum core together. A method of quickly and efficiently assembling a squeegee assembly is also provided.

20 Claims, 17 Drawing Sheets

SQUEEGEE ASSEMBLY

RELATED APPLICATIONS

This application claims the benefit of U.S. Provisional Application No. 61/259,421, filed Nov. 9, 2009, and incorporated herein by reference.

FIELD OF THE INVENTION

The present invention generally relates to surface cleaning equipment. More particularly the present invention relates to a squeegee assembly having a novel tab retention structure for use with such equipment. The tab retention structure cooperates with apertures in the squeegee blades to improve assembly and disassembly of the squeegee assembly.

BACKGROUND OF THE INVENTION

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a squeegee assembly for removing solution from a floor which has been cleaned by application of a cleaning solution of water and a detergent in conjunction with scrubbing action of one or more moving brushes. Accordingly, the squeegee assembly of such prior art cleaning vehicles often mounts at or near the rear of the surface maintenance vehicle to direct the solution to a removal location where the solution (including suspended dirt, particles and contaminants) is removed. In this disclosure, the term "loaded cleaning solution" shall apply to such a cleaning solution after application thereof to a floor or other surface to be cleaned. The cleaning solution is typically supplied to the floor surface through or near rotary scrub brushes operating from a lower portion of the vehicle. The squeegee assembly may include a squeegee supporting member of generally arcuate configuration with two squeegee blades spaced apart and affixed to the supporting member to promote consistent contact with the surface to be cleaned and wiped.

In some prior art cleaning vehicles having two squeegee blades, a vacuum source may couple to the wiping assembly to lift the loaded cleaning solution from the space between the blades to a remote reservoir or other collection unit. The squeegee assembly is often sufficiently wide to at least fully cover the path width of the scrub brushes and/or the wheels of the cleaning vehicle.

The use of squeegee assemblies for wiping a surface and collecting dirty solution is conventional in many applications including but not limited to floor surface cleaning machines such as floor scrubbers. Ideally, the blades of the squeegee assembly are always in full contact with the floor surface and any moisture on the floor surface is exposed to, picked up and carried by air flow in the squeegee assembly. The floor surface plays a major factor in the ability of the squeegee assembly to function as desired. Squeegee assemblies function ideally with a level, smooth floor surface. However, floor surfaces are of a variety of types which are not level and/or completely smooth such as by design as in the case of grouted tile or textured floors, by necessity or damage such as in the case of seams and/or cracks, by wear such as rough or pitted surfaces, and the like. In many instances, the blades are damaged and need to be replaced. In the past, squeegee disassembly and replacement of the blades has been a tedious, time consuming task.

Thus, there is a need for an improved squeegee assembly which has improved assembly and disassembly features.

SUMMARY OF THE INVENTION

The present invention teaches, enables and discloses an improved squeegee assembly usable in a surface maintenance vehicle. Such a vehicle includes those self-powered and manually powered cleaning vehicles applied to the task of removing loaded cleaning solution from a cleaned surface and preferably include all such vehicles using an articulated squeegee assembly; although rigid or fixed squeegee assemblies for such vehicles benefit from the teaching of this disclosure. Such a surface may comprise an interior or exterior floor having some limited porosity but preferably comprising finished concrete (whether painted or sealed), asphalt, ceramic tile, resin-based tile, and the like and including most types of flooring typical of commercial and industrial-grade facilities. However, the teaching hereof finds application in diverse handling of fluids, whether or not "loaded," naturally-occurring liquid(s) or pure cleaning fluid.

One object of the present invention is to provide a squeegee assembly having a tab retention structure. In one embodiment of the present invention the tab retention structure is defined on both a vacuum core structure and a frame structure.

Another object of the invention is the provision of squeegee blades having multiple apertures for engaging a plurality of tabs on the core structure and frame structure.

Thus, the present invention provides a novel squeegee assembly with improved assembly and disassembly features.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE DRAWINGS

Figure 16:
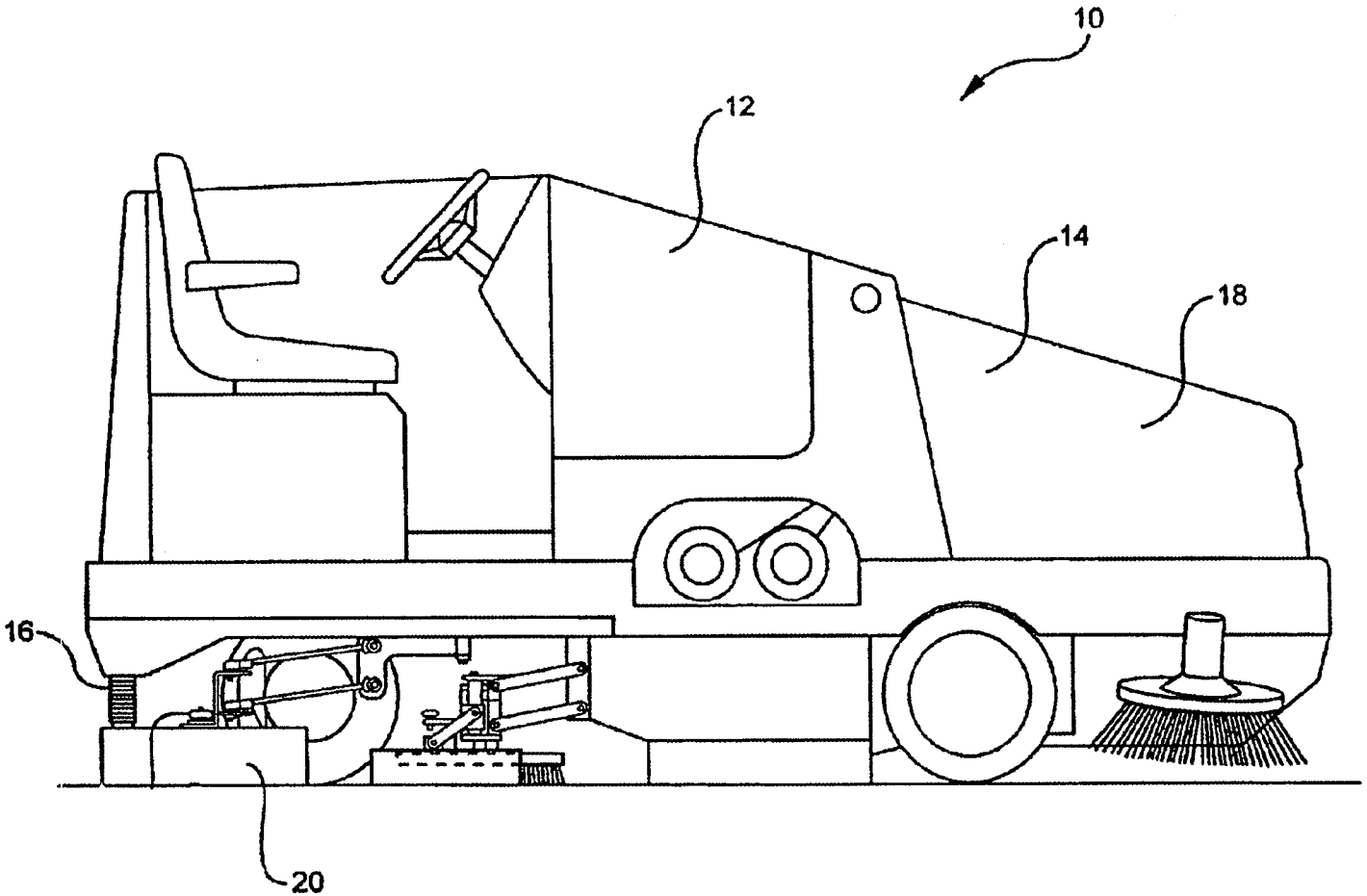
FIG. 16 is an illustration of a prior art surface maintenance machine suitable for use with the squeegee assembly of the present invention.
Figure 17:
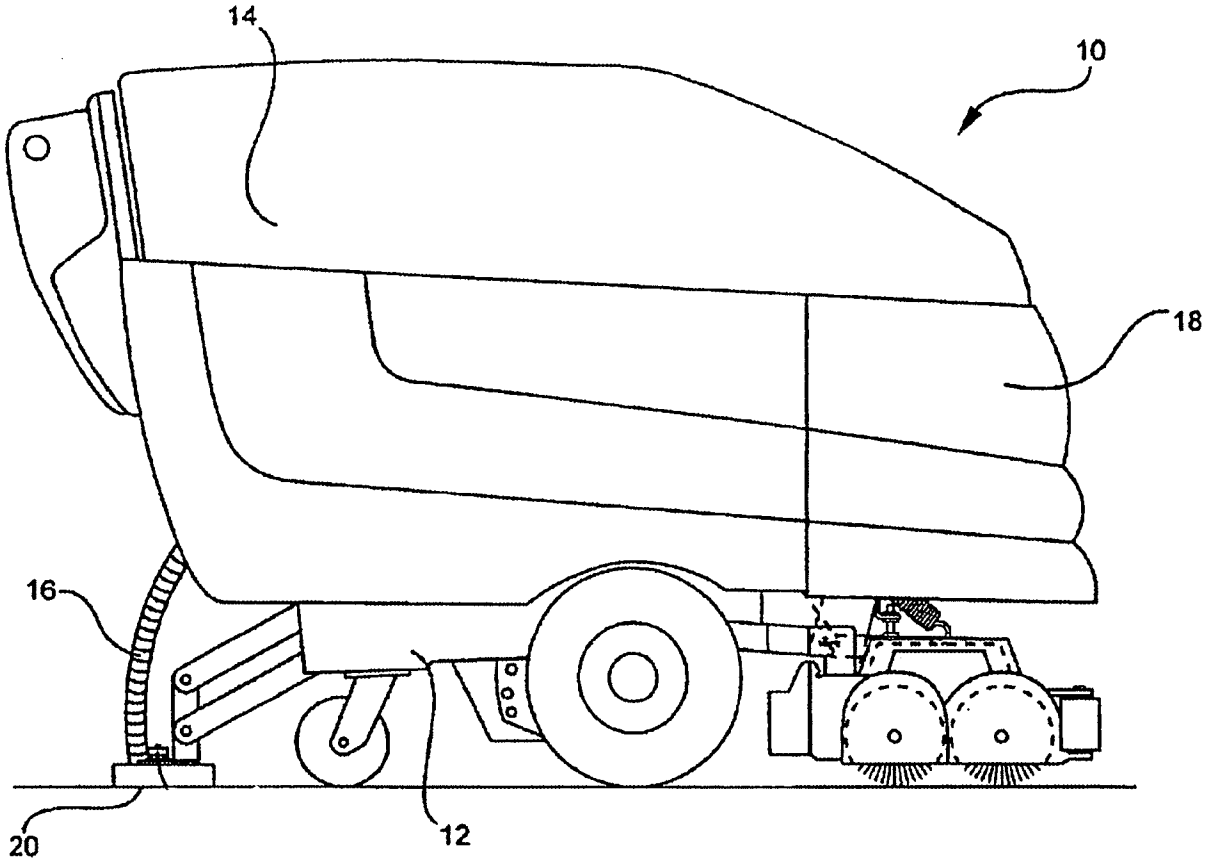
FIG. 17 is an illustration of another prior art surface maintenance machine suitable for use with the squeegee assembly of the present invention.

Examples of industrial sweeper-scrubbers which may utilize the present invention are shown in FIGS. 16 and 17. These surface maintenance machines may be used for sweeping and/or scrubbing floors in factories, warehouses, and other industrial or commercial establishments. As shown in FIG. 16, a riding-type surface maintenance vehicle 10 has a frame 12, and is supported on a plurality of front and rear wheels. Typically, such a surface maintenance vehicle 10 includes a variety of implements such as brushes and systems for dispensing cleaning solutions typically composed of detergent and water which suspend dirt. Vehicle 10 includes a vacuum system including a vacuum fan 14, and a vacuum hose 16 in fluid communication with a recovery tank 18. Herein, a cleaning solution containing suspended dirt and other particles shall be called a "loaded cleaning solution." Loaded cleaning solution and other liquid material are removed by squeegee assembly 20. Squeegee assembly 20 is mechanically coupled near the rear of a surface maintenance vehicle 10. Squeegee assembly 20 may be operatively connected to the surface maintenance vehicle 10 by a releasable attachment device, such as the devices disclosed in U.S. Provisional Patent Application No. 61/259,428, filed Nov. 9, 2009, and U.S. Pat. No. 6,602,018, both of which are incorporated in their entireties by reference herein. One example of such a ride-on surface maintenance vehicle is disclosed in U.S. Pat. No. 5,455,985, incorporated in its entirety by reference herein.

Alternatively, FIG. 17 illustrates a walk-behind surface maintenance vehicle, such a floor scrubbing vehicle disclosed in U.S. Pat. No. 5,483,718, incorporated herein by reference in its entirety. As with the above-mentioned riding-type surface maintenance vehicle, the walk behind surface maintenance vehicle 10 includes variety of implements such as brushes and is capable of applying cleaning solutions. Vehicle 10 includes a vacuum fan 14, a recovery tank 18, and a vacuum conduit 16 providing fluid communication between squeegee assembly 20 and recovery tank 18. Again, loaded cleaning solution and other liquid material are removed by an articulated squeegee assembly 20 located at rear of the surface maintenance vehicle 10. And again, such an articulated squeegee assembly 20 is operatively connected to the surface maintenance vehicle 10 by a releasable attachment device.

Squeegee assembly 20 is oriented with respect to the forward movement direction such that solution tends to be pushed in front of squeegee assembly 20 and is not directed to travel past its ends and in the preferred form shown is of a curved design. However, it can be appreciated that the teachings of the present invention may have application to other types of design including but not limited to a straight design.

Referring to FIGS. 1-15, a squeegee assembly 20 of the present invention includes front and rear flexible blades 22, 24 mounted to a vacuum core structure 26 so that blades 22, 24 are spaced at the center and taper towards each other so that the ends are closely adjacent and/or tight against each other in the preferred form shown. The front blade 22 has notches or slots in the free edge along its length to allow solution to pass therethrough. Blades 22 and 24 contact the floor surface during machine operation. Blades 22 and 24 are made from suitable material such as gum rubber, neoprene, urethane, or the like.

A suction tube 30 is provided in vacuum core structure 26 between blades 22 and 24 and adjacent the centers thereof and to which a vacuum can be supplied such that air and cleaning solution are pulled in through the slots in the front blade 22 or pulled from underneath the front blade 22 and flow out of tube 30, with the rear blade 24 acting as a wiper to leave the floor surface dry. Suction tube 30 is in fluid communication with a recovery tank in turn in fluid communication with a vacuum assembly which draws air from the hollow interior of the recovery tank.

Particularly, in the form shown in FIGS. 9-12, vacuum core 26 includes a top 32 which in the preferred form can be suitably removably secured to a mount of suitable provisions for operatively engaging squeegee assembly 20 on the floor surface during an operation mode as well as for raising squeegee assembly 20 from the floor surface during a transport or storage mode. However, top 32, the manner of removably securing squeegee assembly 20 to a mount, and/or squeegee assembly 20 can be of a variety of forms and constructions according to the teachings of the present invention.

Vacuum core 26 further includes a front 40 and a back 42 which extend generally perpendicular to the surface to be wiped. In the most preferred form, front 40 and back 42 are curved between their ends parallel to the surface to be wiped. The curvature of front 40 is larger than the curvature of back 42.

Front blade 22 abuts with the front surface of front 40 (opposite to back 42). Similarly, rear blade 24 abuts with the back surface of back 42. In the preferred form shown, blade 24 has a thickness less than blade 22 but could have equal thickness or different relative thicknesses according to the particular material from which blades 22 and 24 are formed. Likewise, in an unflexed and vertical position, blade 24 has a lower extent elevated above the lower extent of blade 22 in the form shown. In a preferred form, blades 22 and 24 are reversible so that both elongated edges can be oriented to be the lower wiping edges.

Vacuum core 26 includes a bottom 46 extending between front 40 and back 42 in a spaced generally parallel relation to top 32. In the most preferred form, vacuum core 26 is substantially hollow for weight reduction reasons and for ease of removal and assembly, with front 40, back 42, top 32 and bottom 46 interconnected together via a casting. However, vacuum core 26 according to the preferred teachings of the present invention can be formed in other manners such as by plates or moldings and can be of other types. Vacuum core 26 includes a plurality of tabs 48 protruding from back surface 42. Tabs 48 in the illustrated embodiment are generally linear protrusions. In alternative embodiments, tabs 48 may be round or another shape. Tabs 48 are adapted to engage the plurality of apertures 49 in rear blade 24.

Front blade 22, rear blade 24 and vacuum core 26 are held against frame 50 via clamp band 52. Frame 50 includes clamp band engaging hooks 56 near ends of frame 50. Clamp band 52 includes a stationary latch structure 58 on one end and a movable latch 60 on the other end. Movable latch 60 is selectively manipulated to secure clamp band 52 to frame 50, such as during assembly of squeegee assembly 20.

Clamp band 52 is serrated along one edge 53, with the serrations being spaced in relation to tabs 48 and apertures 49 as described in more detail hereinafter. Movable latch 60 may include a variety of different latching or securing structures effective to adjust a length of band 52 during assembly and disassembly of squeegee assembly 20.

Figure 9:
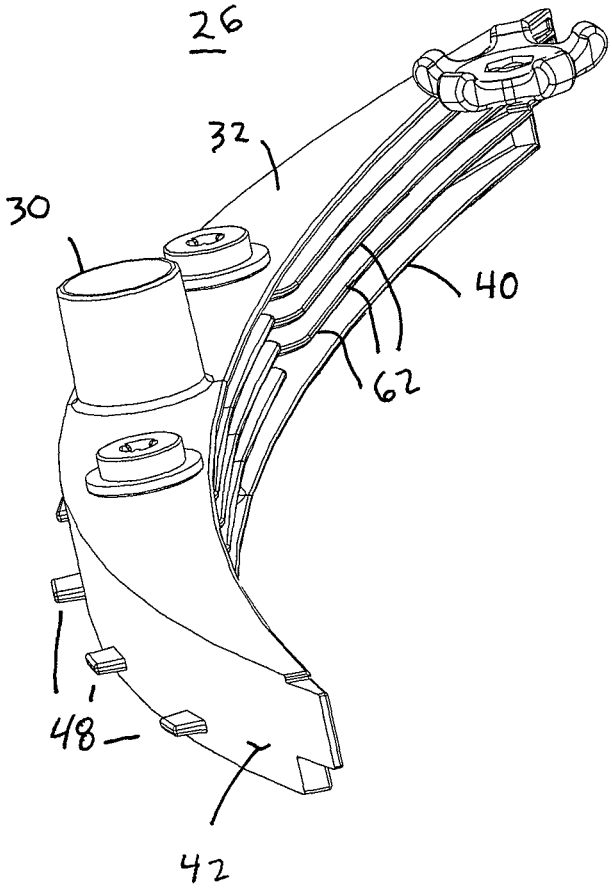
FIGS. 9-11 are perspective illustrations of the vacuum core of the squeegee assembly of FIG. 1.

At the front surface 40 of vacuum core 26, a plurality of divisions are defined by curved webs 62 of the cast structure, as shown in FIG. 9. The webs 62 together define a curved surface which engages the front squeegee blade 22.

Frame 50 includes a plurality of tabs 64 which are spaced in relation to apertures 66 on the front squeegee blade 22. The tabs 64 are defined as protrusions from a curved surface 68 of frame 50. The tabs 64 are adapted to be inserted into the divisions defined by the curbed webs 62 of vacuum core 26.

Figure 1:
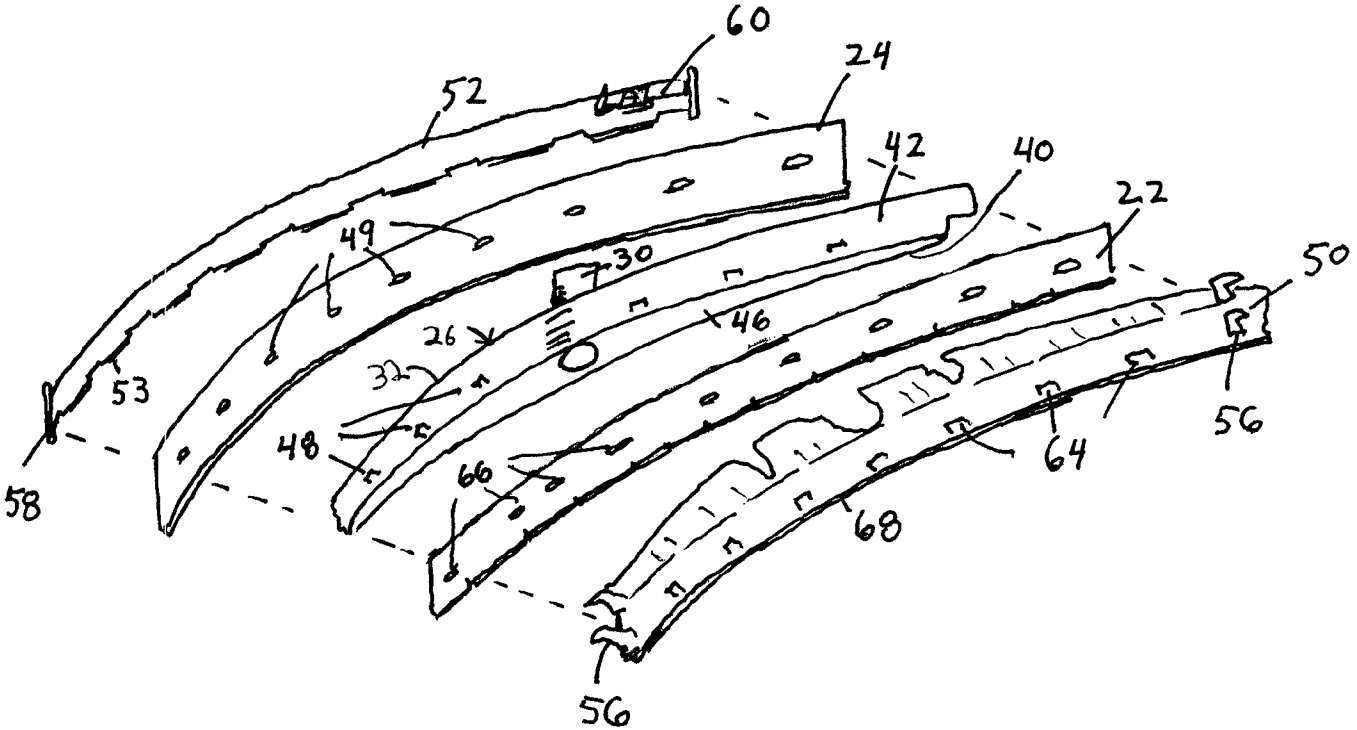
FIG. 1 is a perspective view of a disassembled squeegee assembly of the present invention.
Figure 2:
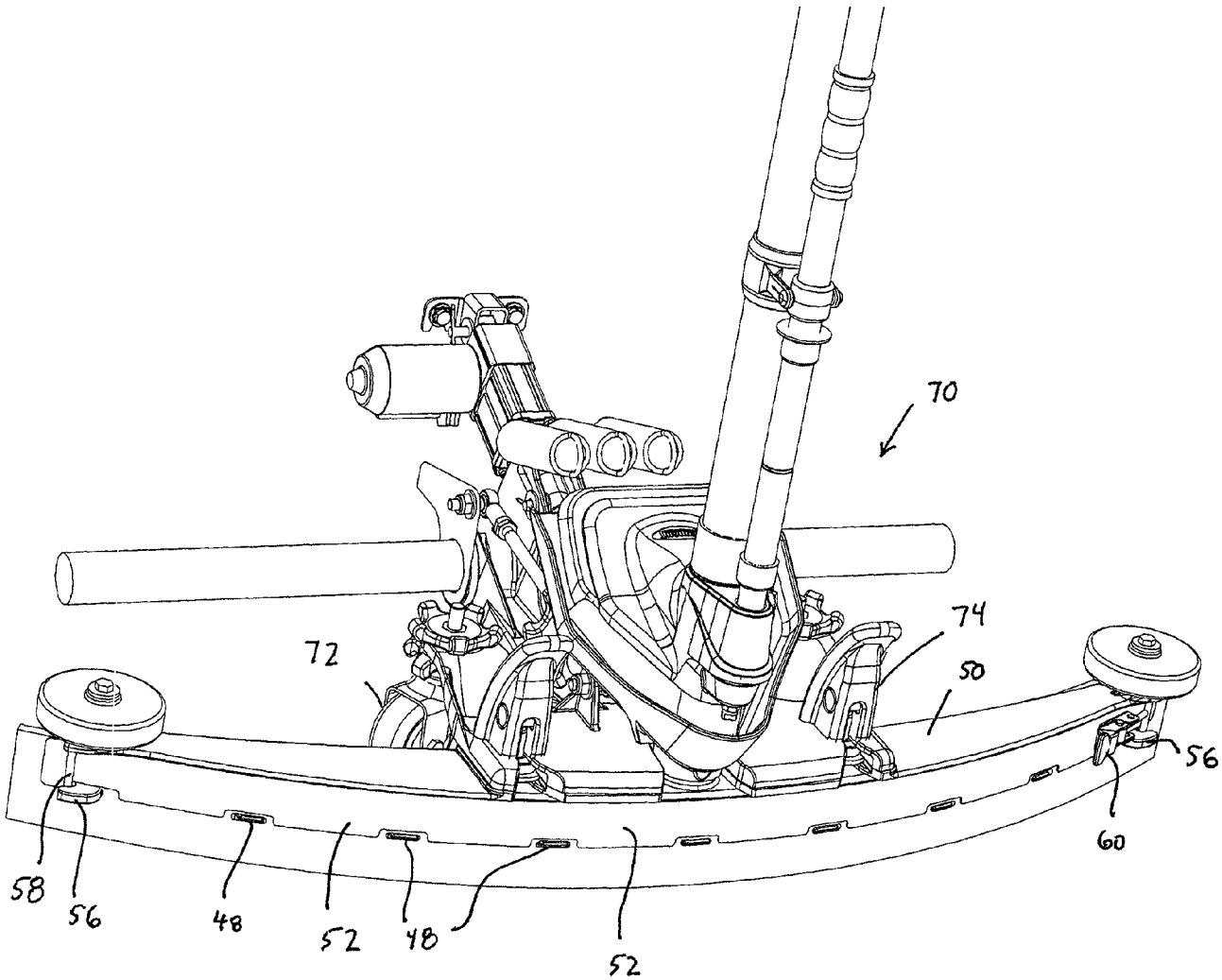
FIGS. 2-4 are perspective illustrations of the squeegee assembly of FIG. 1 as attached to a squeegee linkage of a surface maintenance machine.

FIG. 2 illustrates squeegee assembly 20 as attached to supporting components 70 of a surface maintenance machine. Supporting components 70 include wheels 72 and quick-release structure 74, such as disclosed in U.S. Ser. No. 61/259,428, entitled "Quick Lock Squeegee Attachment" and incorporated by reference herein.

Figure 3:
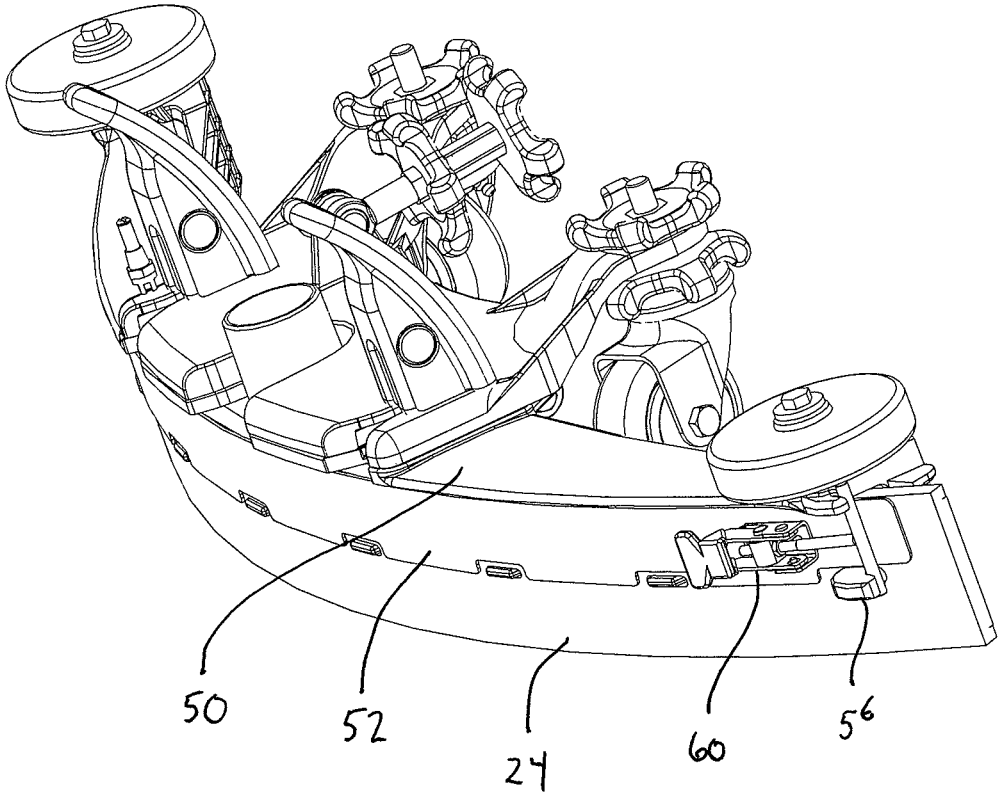

FIG. 3 illustrates squeegee assembly 20 as attached to supporting components 70 of FIG. 2.

Figure 4:
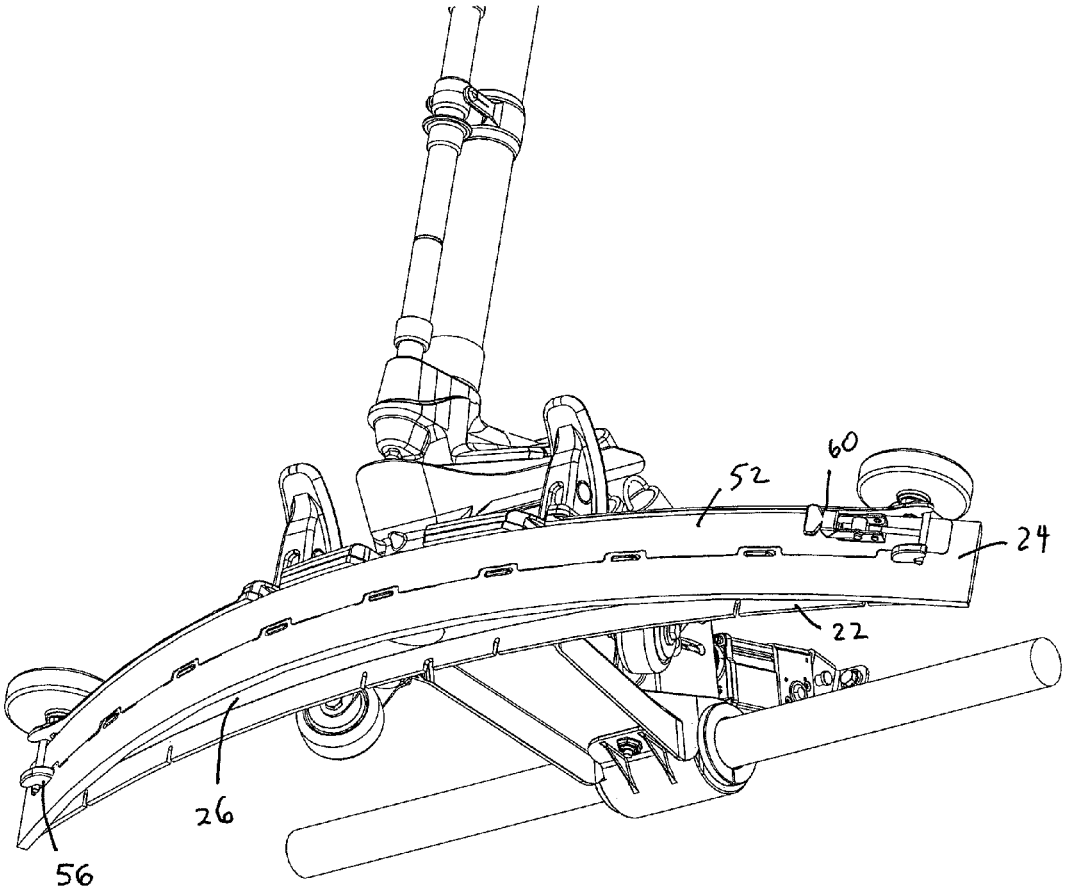

FIG. 4 illustrates the underside of squeegee assembly 20 of FIG. 2.

Figure 5:
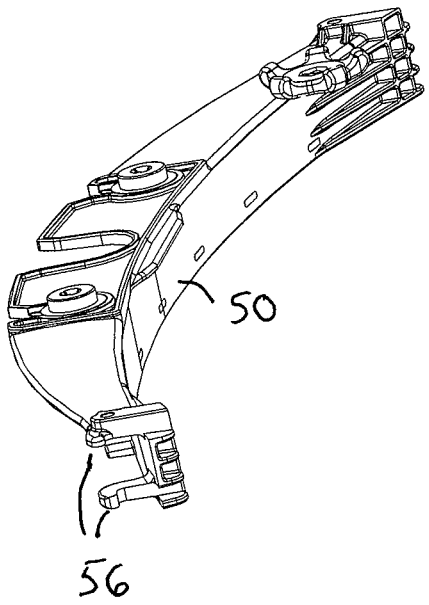
FIGS. 5-8 are perspective illustrations of the frame of the squeegee assembly of FIG. 1.

FIG. 5 is a perspective view of frame 50, showing clamp band engaging hooks 56 near one end of frame 50.

Figure 6:
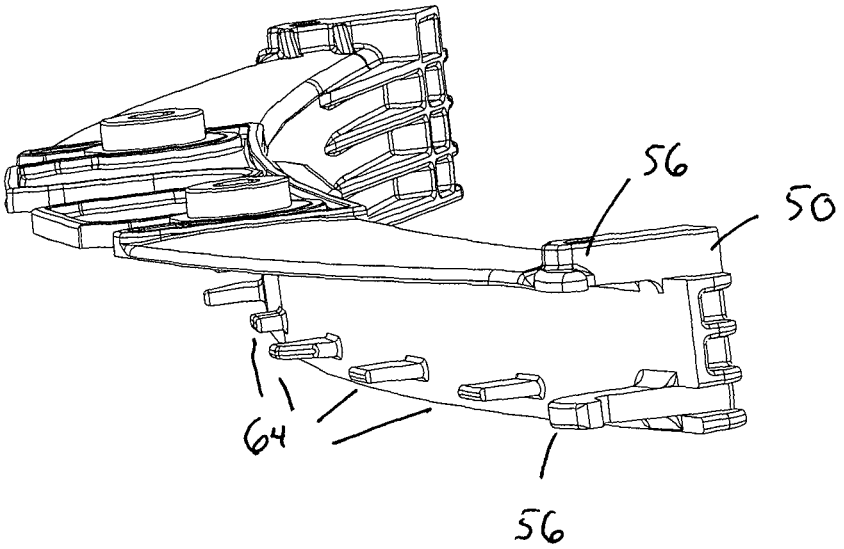

FIG. 6 is a perspective view of frame 50, showing clamp band engaging hooks 56 and tabs 64. As described herein, tabs 64 are sized to be received into the plurality of divisions defined by curved webs 62 of the vacuum core 26.

Figure 7:
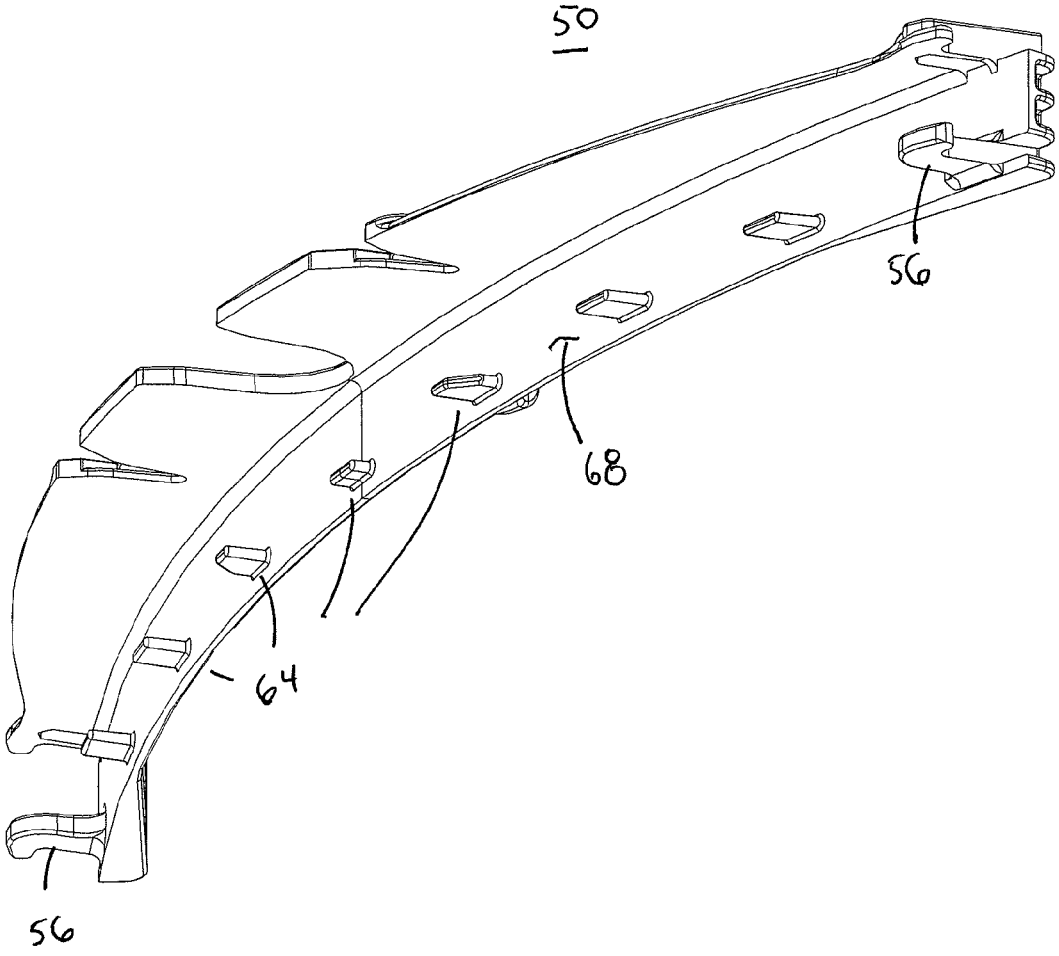
Figure 8:
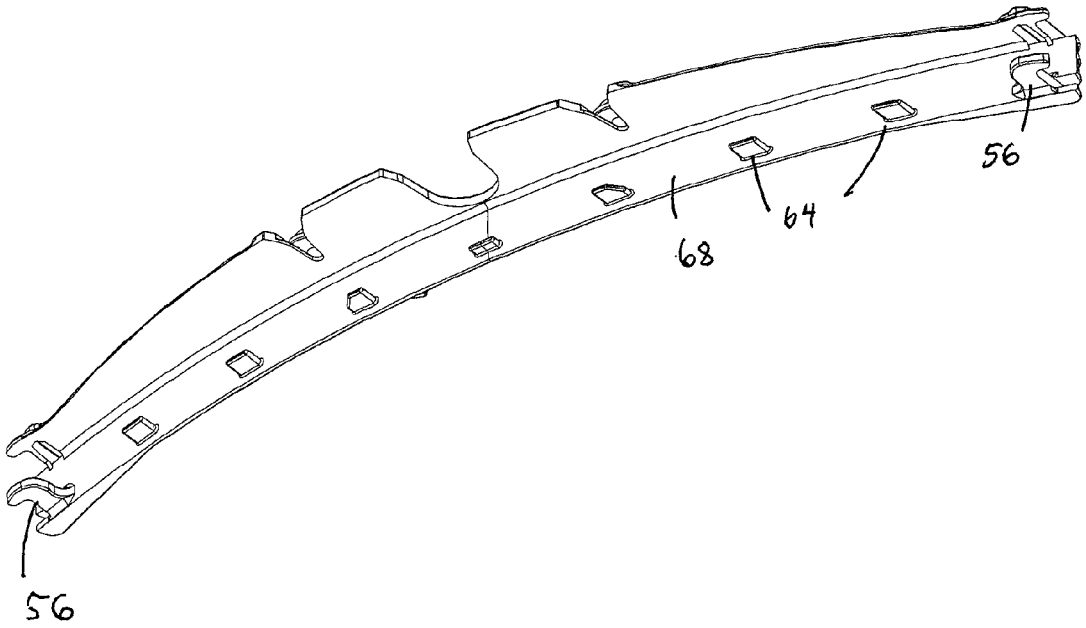

FIGS. 7 and 8 are perspective views of frame 50 showing the plurality of clamp band engaging hooks 56 near ends of frame 50.

FIG. 9 is a perspective view of vacuum core 26 showing the plurality of tabs 48 on rear surface 42 and the plurality of curved webs 62 on a front surface 40.

Figure 10:
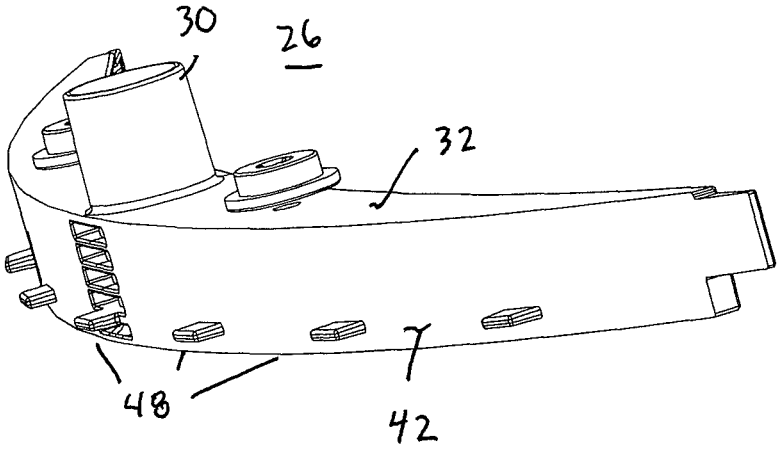
Figure 11:
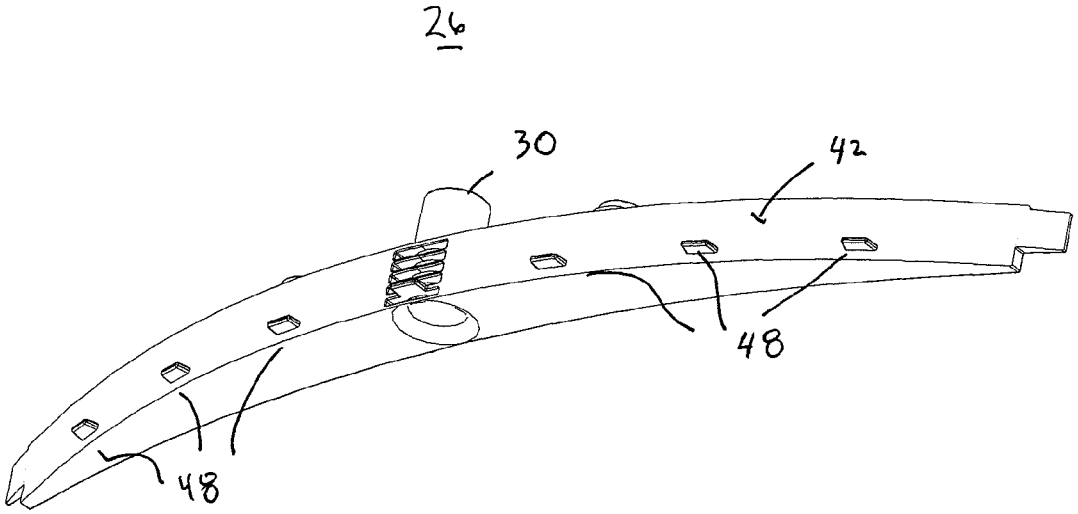

FIGS. 10 and 11 are perspective views or vacuum core 26 showing vacuum conduit 30, the plurality of tabs 48 extending from rear surface 42.

Figure 12:
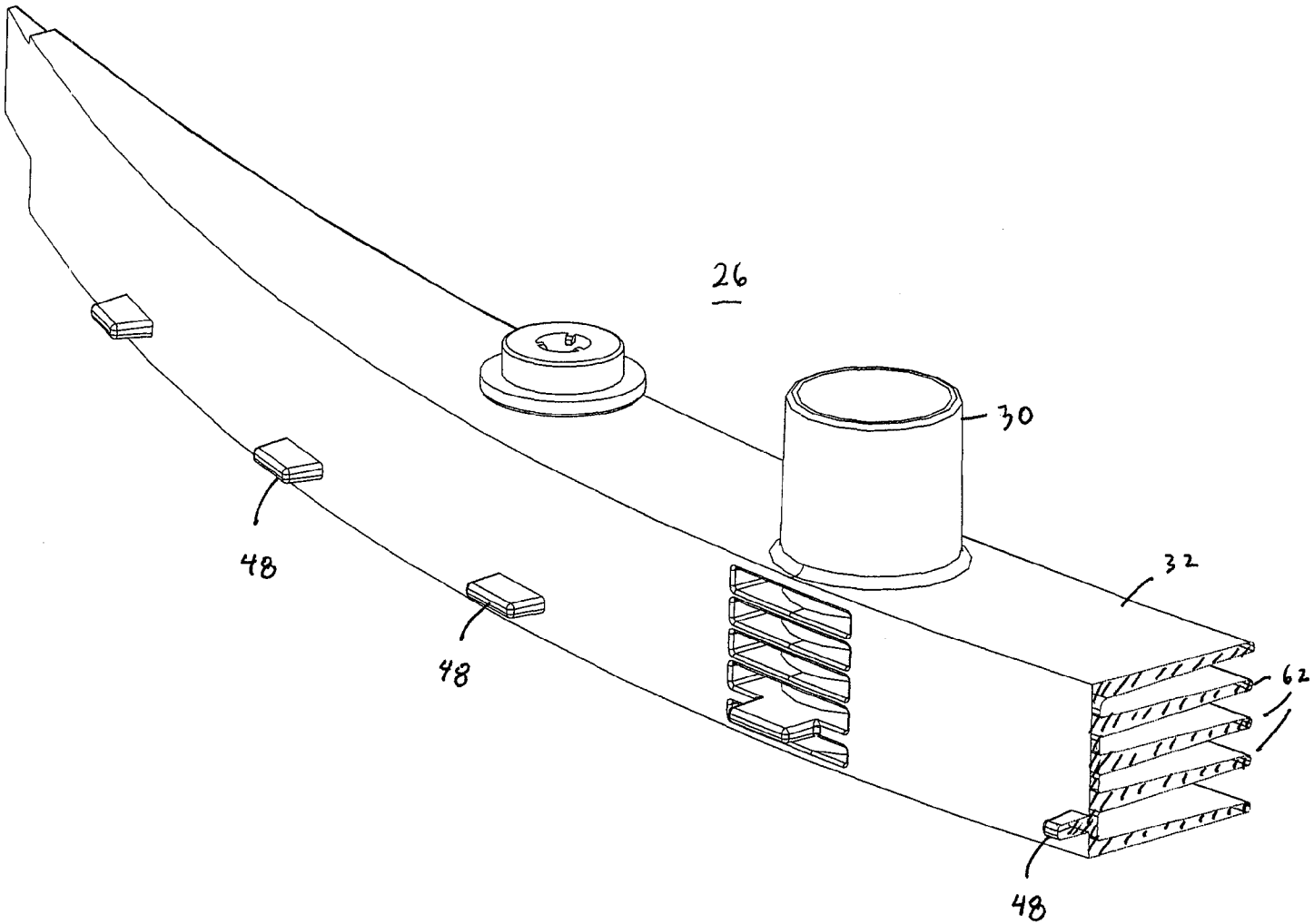
FIG. 12 is a cross sectional view of the vacuum core.

FIG. 12 is a cross-sectional view of vacuum core 26 taken through one of the plurality of tabs 48 and showing the divisions between the plurality of webs 62.

Figure 13:
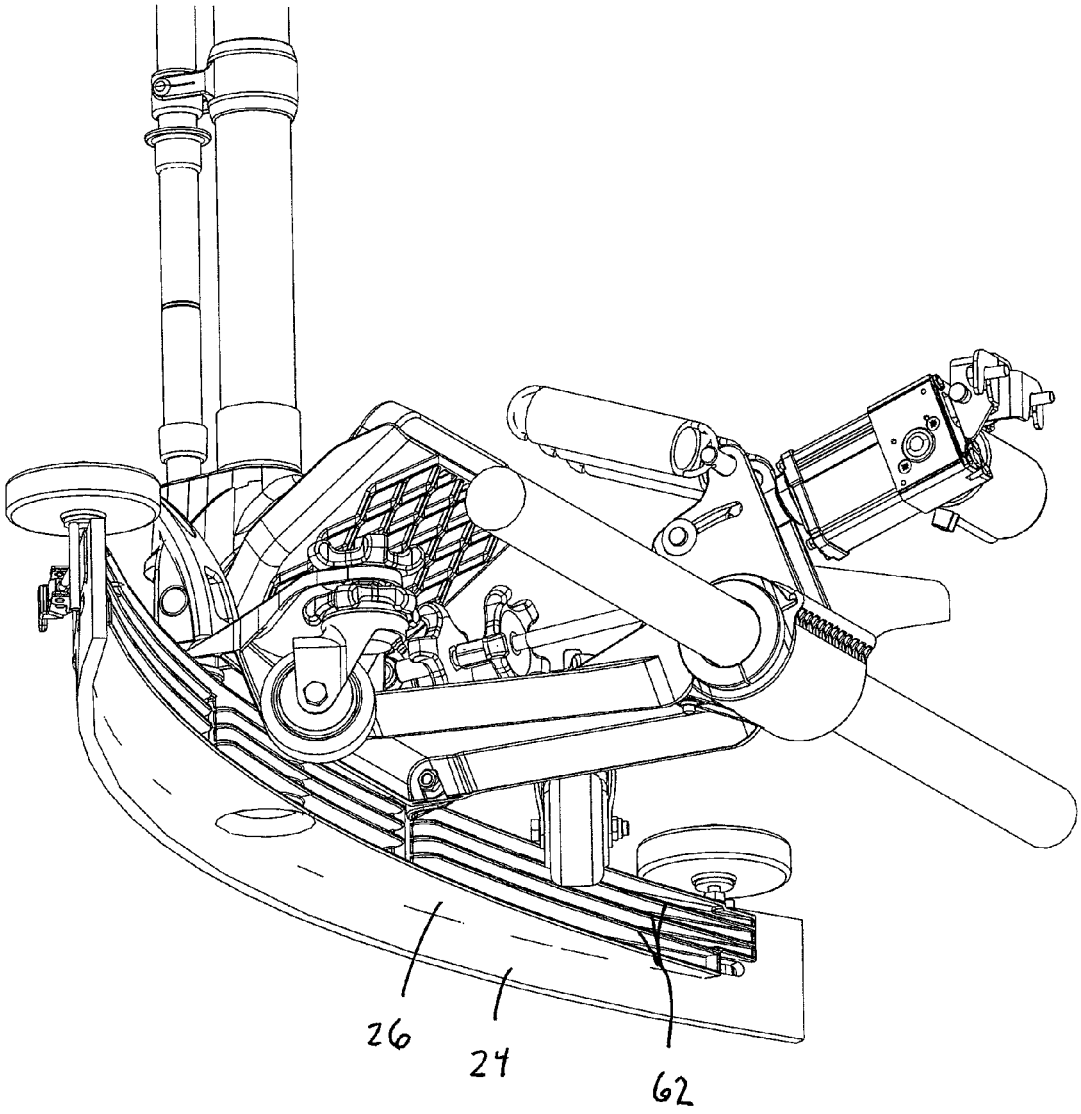
FIG. 13 is a perspective illustration of the squeegee assembly of FIG. 1, shown with the frame and front blade removed.

FIG. 13 is a perspective view of squeegee assembly 20 and connecting structure 70 with the front squeegee blade 22 and frame 50 removed.

Figure 14:
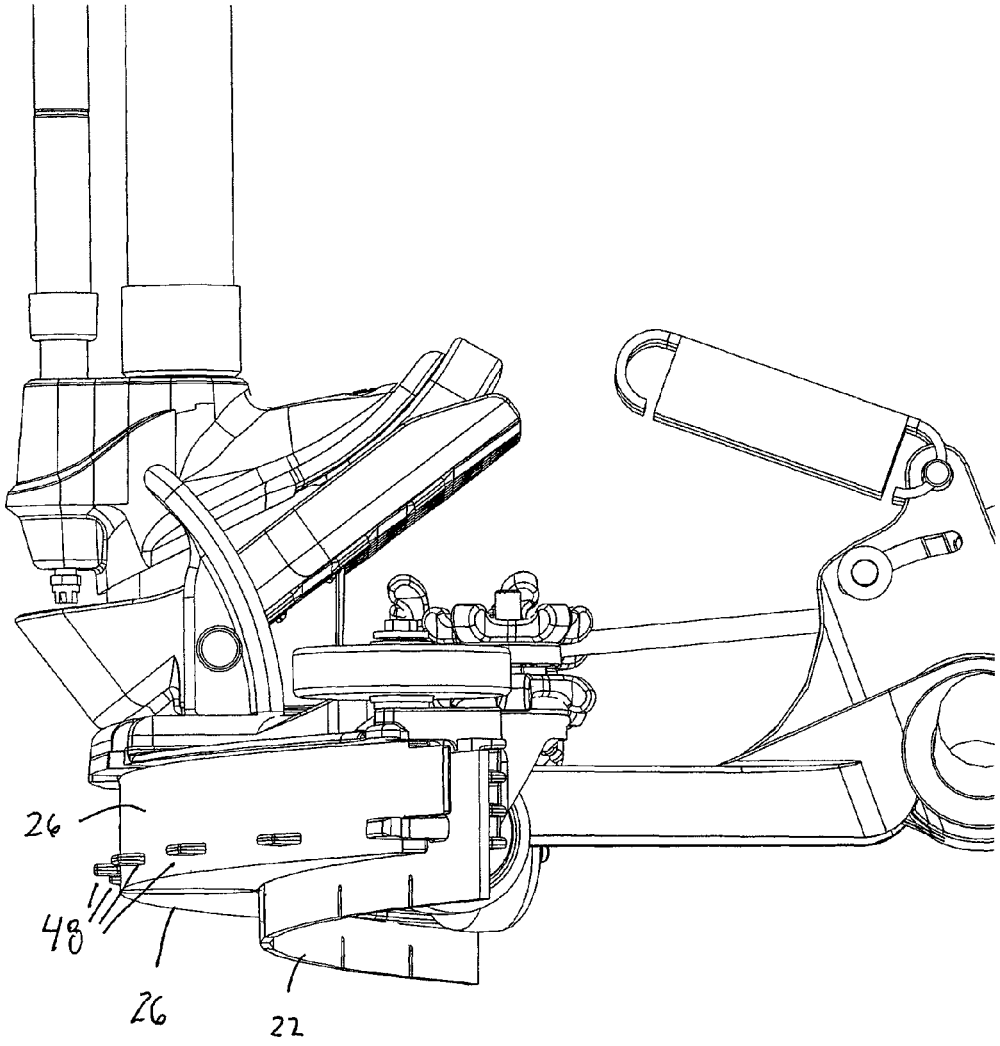
FIG. 14 is a perspective illustration of the squeegee assembly of FIG. 1, shown with the rear squeegee blade removed.

FIG. 14 is a perspective view of squeegee assembly 20 and connecting structure 70 with the rear squeegee blade 24 removed.

Figure 15:
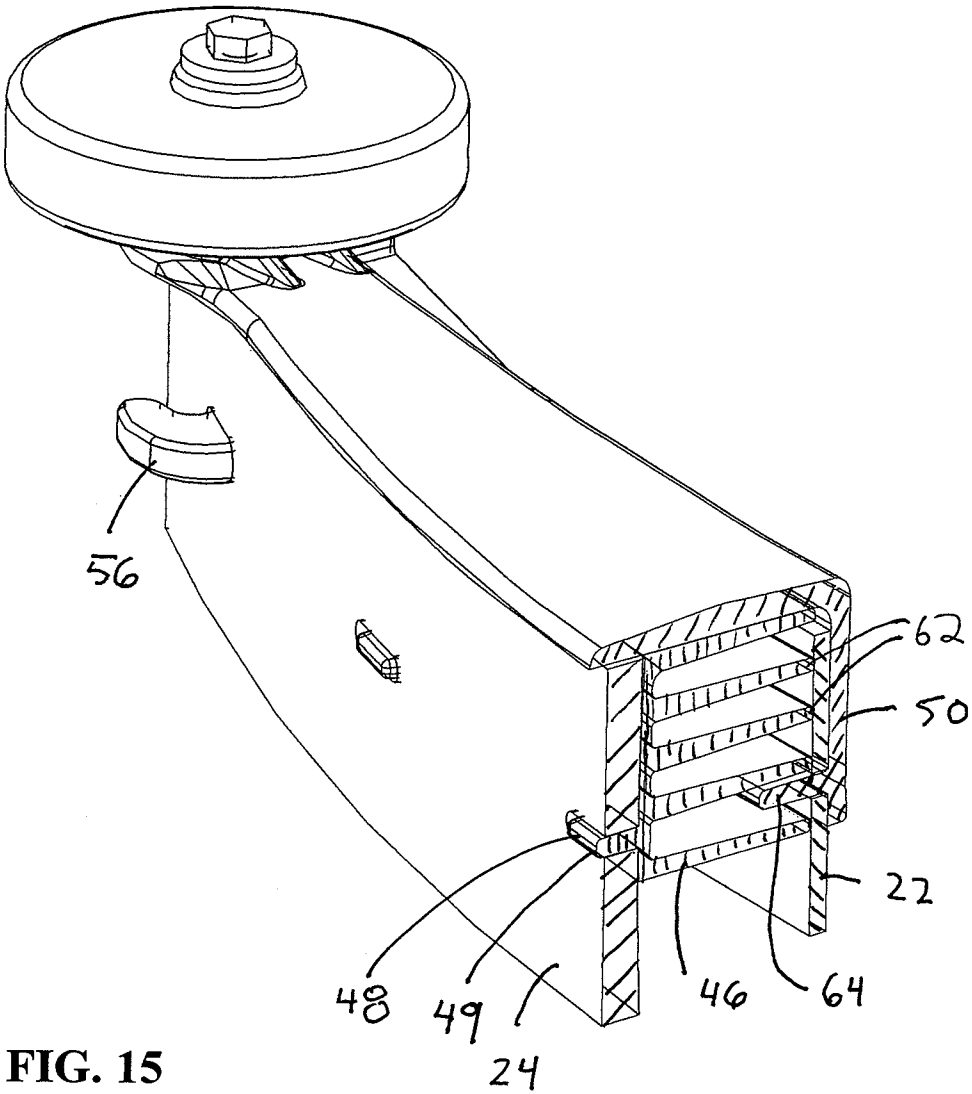
FIG. 15 is a cross sectional view taken through the squeegee assembly of FIG. 1.

FIG. 15 is a cross-sectional view taken through squeegee assembly 20 showing the interaction between tabs 48 and apertures 49 and between tabs 64 and webs 62.

Now that the basic construction of squeegee assembly 20 according to the preferred teachings of the present invention has been set forth, the operation and some of the advantages of squeegee assembly 20 can be highlighted. Specifically, a method of assembly of a squeegee assembly 20 includes providing a frame 50 having a plurality of tabs 64, placing the front blade 22 upon curved surface 68 of frame 50, with the tabs 64 being received within the plurality of apertures 66 of front blade 22, and with portions of the tabs 64 extending beyond the front blade 22 as so placed, placing the front surface of the vacuum core 26 on the front blade 22 with said portions of the tabs 64 being inserted into divisions defined by the curved webs 62 of the vacuum core 26, placing the rear blade 24 on the rear surface of the vacuum core 26, with tabs 48 of the vacuum core 26 being aligned with apertures 49 in the rear blade 24, and clamping the vacuum core 26, front blade 22, rear blade 24 and frame 50 together with the clamp band 52. Clamping with the clamp band 52 may be achieved via manipulation of the movable latch 60 after the stationary latch 58 is coupled to the engaging hooks 56 opposite the movable latch 60. Disassembly of the squeegee assembly 20 is the reverse procedure.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A squeegee assembly for a floor surface maintenance machine comprising:

a frame having a plurality of tabs protruding from a curved surface;

a front squeegee blade having a plurality of apertures spaced along a length of the blade and adapted to receive at least portions of the plurality of tabs of said frame;

a vacuum core having a surface adapted to receive portions of said plurality of tabs of said frame extending through apertures of the front squeegee blade, with said vacuum core having a plurality of tabs protruding from a curved rear surface;

a rear squeegee blade having a plurality of apertures spaced along a length of the blade and adapted to receive at least portions of said plurality of tabs protruding from said curved rear surface of said vacuum core; and a clamp band for securing the frame, front and rear squeegee blades and vacuum core together.

2. The squeegee assembly of claim 1 wherein the apertures of the front squeegee blade and rear squeegee blade are elongated slots centered about a longitudinal axis of each blade.

3. The squeegee assembly of claim 1 wherein the frame includes a plurality of hooks adapted to engage ends of said clamp band.

4. The squeegee assembly of claim 3 wherein one end of the clamp band couples to a pair of hooks of the frame via a stationary latch and the other end couples to another pair of hooks via a movable latch.

5. The squeegee assembly of claim 1 wherein the vacuum core includes a curved front side defined by a plurality of divisions and the plurality of tabs of the frame are adapted to be inserted into one of said plurality of divisions.

6. The squeegee assembly of claim 1 wherein the vacuum core includes a cylindrical vacuum outlet adapted to engage a vacuum hose of the floor maintenance machine.

7. A squeegee assembly for a floor surface maintenance machine comprising:

a curved frame having a plurality of tabs protruding from a surface;

a front squeegee blade having a plurality of apertures spaced along a length of the blade and adapted to receive at least portions of the plurality of tabs of said frame;

a vacuum core having a curved surface adapted to engage the front squeegee blade and also receive portions of said plurality of tabs of said frame extending through apertures of the front squeegee blade, with said vacuum core having a plurality of tabs protruding from a curved rear surface;

a rear squeegee blade having a plurality of apertures spaced along a length of the blade and adapted to receive at least portions of said plurality of tabs ef protruding from said curved rear surface of said vacuum core; and a clamp band extending across the rear squeegee blade and engaging ends of said curved frame, said clamp band restraining the vacuum core and squeegee blades against the frame.

8. The squeegee assembly of claim 7 wherein the apertures of the front squeegee blade and rear squeegee blade are elongated slots centered along a longitudinal axis of each blade.

9. The squeegee assembly of claim 7 wherein the frame includes a plurality of hooks adapted to engage ends of said clamp band.

10. The squeegee assembly of claim 9 wherein one end of the clamp band couples to a pair of hooks of the frame via a stationary latch and the other end couples to another pair of hooks via a movable latch.

11. The squeegee assembly of claim 7 wherein the vacuum core includes a curved front side defined by a plurality of divisions and the plurality of tabs of the frame are adapted to be inserted into one of said plurality of divisions.

12. The squeegee assembly of claim 7 wherein the vacuum core includes a cylindrical vacuum outlet adapted to engage a vacuum hose of the floor maintenance machine.

13. The squeegee assembly of claim 12 wherein the vacuum core is a cast-metal component with the plurality of divisions and plurality of tabs integral to said vacuum core.

14. The squeegee assembly of claim 13 wherein the divisions of the vacuum core are defined as elongated webs of a cast vacuum core.

15. The squeegee assembly of claim 14 wherein the plurality of tabs of said frame are sized to be inserted between a pair of said elongated webs of the cast vacuum core.

16. The squeegee assembly of claim 15 wherein ends of the plurality of divisions of said vacuum core support the front squeegee blade in generally vertical alignment during operation of said floor maintenance machine.

17. The squeegee assembly of claim 15 wherein thicknesses of the webs and other portions of the vacuum core are substantially equal.

18. A method of assembly for a squeegee blade assembly comprising:

providing a frame having a plurality of tabs extending from a curved surface of said frame;

placing a front blade upon the curved surface of said frame, with the plurality of tabs being received within a plurality of apertures of said front blade, with said plurality of apertures being spaced along a length of the front blade, and with portions of the tabs extending beyond the front blade as so placed;

placing a front surface of a vacuum core on the front blade with said portions of the plurality of the tabs of the frame being inserted into divisions of the vacuum core;

placing a rear blade on a rear surface of the vacuum core, with rear tabs of the vacuum core being aligned with apertures in the rear blade; and clamping the vacuum core, front blade, rear blade and frame together with a clamp band.

19. The method of claim 18 wherein said clamping is achieved via manipulation of a movable latch after a stationary latch is coupled to engaging hooks of the frame opposite the movable latch.

20. The method of claim 19 wherein said placing of the front blade or rear blade includes reversing the front blade or rear blade to exchange a worn portion of the front blade or rear blade away from engagement with a floor surface.

* * * * *